US008555419B2

(12) United States Patent
Demarest et al.

(10) Patent No.: US 8,555,419 B2
(45) Date of Patent: Oct. 15, 2013

(54) RESILIENT BAND FOR ARTICLE OF APPAREL

(75) Inventors: Nate Demarest, Portland, OR (US); Travis Harvey, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 606 days.

(21) Appl. No.: 12/433,878

(22) Filed: Apr. 30, 2009

(65) Prior Publication Data

US 2010/0275344 A1 Nov. 4, 2010

(51) Int. Cl.
*A41D 1/06* (2006.01)

(52) U.S. Cl.
USPC ..... 2/237

(58) Field of Classification Search
USPC ..... 2/237, 236, 307, 221; 237/237, 236, 237/307, 221
See application file for complete search history.

(56) References Cited

U.S. PATENT DOCUMENTS

| | | | | | |
|---|---|---|---|---|---|
| 175,439 | A | * | 3/1876 | Eager | 2/237 |
| 1,291,048 | A | * | 1/1919 | Cohen | 2/76 |
| 1,729,265 | A | * | 9/1929 | Sinclair | 2/237 |
| 1,789,823 | A | * | 1/1931 | Lehman | 2/237 |
| 1,873,583 | A | * | 8/1932 | Hargreaves | 2/237 |
| 1,951,450 | A | * | 3/1934 | Sochel | 2/237 |
| 2,113,201 | A | * | 4/1938 | Scheitlin | 112/413 |
| 2,183,257 | A | * | 12/1939 | Hardie et al. | 112/414 |
| 2,277,227 | A | * | 3/1942 | Hardie | 2/237 |
| 2,343,374 | A | * | 3/1944 | Hargreaves | 2/237 |
| 2,617,113 | A | * | 11/1952 | Hardie | 2/237 |
| 2,619,648 | A | * | 12/1952 | Hardie | 2/237 |
| 2,721,331 | A | * | 10/1955 | Scheitlin | 2/237 |
| 2,751,599 | A | * | 6/1956 | Peterson | 2/237 |
| 3,040,330 | A | * | 6/1962 | Hardie | 2/237 |
| 3,064,269 | A | * | 11/1962 | Scheitlin | 2/221 |
| 3,414,907 | A | * | 12/1968 | Flame | 2/221 |
| 3,559,213 | A | * | 2/1971 | Goodman | 2/237 |
| 3,843,973 | A | * | 10/1974 | Dillenburger | 2/236 |
| 3,868,729 | A | * | 3/1975 | Lynam | 2/237 |
| 4,583,478 | A | * | 4/1986 | Bassetti | 112/413 |
| 4,606,964 | A | * | 8/1986 | Wideman | 428/152 |
| 4,701,964 | A | * | 10/1987 | Prunesti et al. | 2/406 |
| 4,761,324 | A | * | 8/1988 | Rautenberg et al. | 428/198 |

(Continued)

FOREIGN PATENT DOCUMENTS

| | | |
|---|---|---|
| GB | 1392199 | 4/1975 |
| WO | WO 95/34264 | 12/1995 |
| WO | WO 00/37003 | 6/2000 |

OTHER PUBLICATIONS

International Search Report dated Sep. 17, 2010, International Application No. PCT/US2010/033139, International Filing Date Apr. 30, 2010.

(Continued)

*Primary Examiner* — Richale Quinn
(74) *Attorney, Agent, or Firm* — Plumsea Law Group, LLC

(57) ABSTRACT

A resilient band for use with articles of apparel, the band is formed with a first fabric operably secured to a strip of more resilient material that is preferably a second fabric such as powermesh or the like. The band is formed by stretching the first fabric and resilient material into a stretched position and operably securing the two materials together with a fastening structure. Preferably, the fastening structure is a plurality of spaced-apart stitching line that are parrellely aligned with each other and substantially perpendicularly aligned with the longitudinal length of the band.

32 Claims, 3 Drawing Sheets

(56) References Cited

U.S. PATENT DOCUMENTS

| | | | | |
|---|---|---|---|---|
| 4,935,287 | A * | 6/1990 | Johnson et al. | 428/198 |
| 5,244,716 | A * | 9/1993 | Thornton et al. | 428/198 |
| 5,375,266 | A * | 12/1994 | Crisco | 2/243.1 |
| 5,483,702 | A * | 1/1996 | D'Ambrosio | 2/237 |
| 5,576,090 | A * | 11/1996 | Suzuki | 428/152 |
| 5,675,842 | A * | 10/1997 | Schaefer | 2/237 |
| 5,683,787 | A * | 11/1997 | Boich et al. | 428/198 |
| 5,882,769 | A | 3/1999 | McCormack et al. | |
| 6,286,341 | B2 * | 9/2001 | Jackson et al. | 66/83 |
| 7,181,775 | B2 * | 2/2007 | Carney | 2/311 |
| 7,676,852 | B1 * | 3/2010 | Carney | 2/311 |
| 7,834,236 | B2 * | 11/2010 | Middlesworth et al. | 604/378 |
| 2004/0171325 | A1 * | 9/2004 | Woods | 442/361 |
| 2007/0028364 | A1 * | 2/2007 | Oomae | 2/237 |
| 2007/0106350 | A1 * | 5/2007 | Carstens | 607/108 |
| 2007/0106352 | A1 * | 5/2007 | Carstens | 607/112 |
| 2008/0078012 | A1 * | 4/2008 | Mario | 2/237 |
| 2009/0038046 | A1 | 2/2009 | Moore | |

OTHER PUBLICATIONS

Written Opinion dated Sep. 17, 2010, International Application No. PCT/US2010/033139, International Filing Date Apr. 30, 2010.

Extended European Search Report dated Feb. 25, 2013, EP Application No. 10770409.3, Filed Apr. 30, 2010.

* cited by examiner

RESILIENT BAND FOR ARTICLE OF APPAREL

FIELD

The present disclosure relates to a flexible, bulk-free, resilient band for an article of apparel, and more particularly, relates to forming the resilient band by joining a first sheet of fabric to a second, more resilient, thin sheet of fabric to form a waistband and the like.

BACKGROUND

Resilient bands, such as waistbands, wristbands, and the like, are commonly used on articles of apparel, such as pants, jackets, and the like, to snugly secure the article of apparel to the wearer.

In general, these bands should snugly synch the article of apparel to the wearer, but remain flexible enough so as to not limit the wearer's full range of movement or feel too tight by the wearer. In addition, it is often desirable for the band to be as thin as possible so as to prevent the band from feeling bulky by the wearer. For example, waistbands on yoga pants must be particularly flexible and bulk-free, yet still secure the pants to the wearer throughout the wearer's full range of motion.

Known waistbands and the like tend to inadvertently compromise, comfort, fit, or the range of motion of the wearer. For example, a commonly used waistband design includes sewing a relatively thick elastic band to a strip of outer fabric to form one or more substantially horizontal seams. While effective as a waistband, this structure tends to feel bulky and not particularly resilient, and it tends to limit the range of motion of the wearer, particularly when used in yoga apparel. Moreover, elastic bands tend to lose some of their elasticity with repeated use over time.

Accordingly, despite the benefits of known resilient band structures used on articles of apparel, there remains a need for a cost effective, durable, light weight, bulk-free resilient band that allows a full range of movement of the wearer without compromising the ability of the band to hold onto its wearer.

SUMMARY

The present invention overcomes these and other shortfalls with the known resilient band structures. A resilient band for use with articles of apparel that is formed with a first fabric operably secured to a more resilient elastic, and preferably fabric, structure is disclosed.

Disclosed preferred embodiment includes the fabric and elastic structure first being placed in a stretched position along their longitudinal lengths. They are then operably secured together with fastening structures that are preferably aligned substantially perpendicular to their longitudinal lengths. The resulting resilient band is extremely flexible and comfortable while still allowing it to effectively grasp the wearer throughout the entire range of movement of the wearer.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

FIG. 1 a schematic view of an article of apparel having a resilient band in accordance with an embodiment of the present invention.

Figure 3:
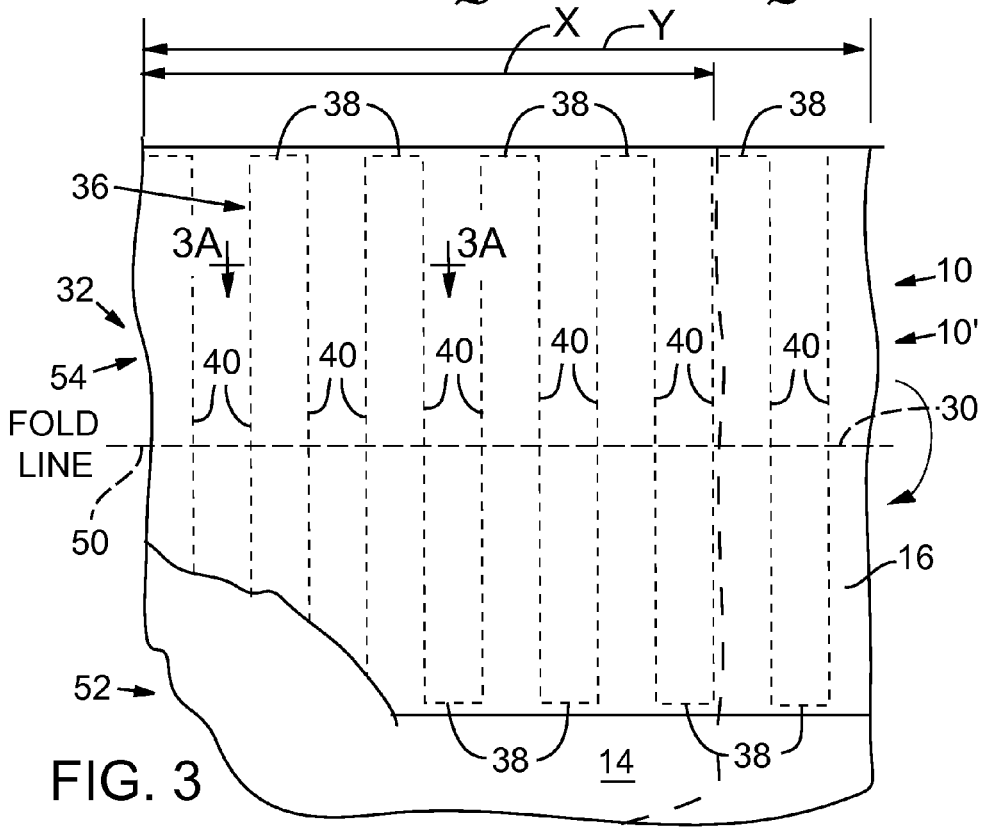
FIG. 3 is a partial, front view of the resilient band of FIG. 2A showing a possible neutral position X and stretched position Y.
Figure 3A:
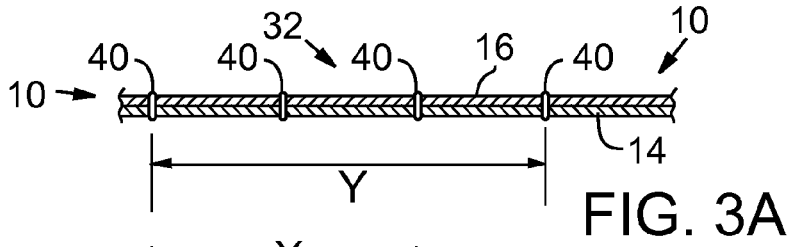

FIG. 3A a partial, top view of the resilient band of FIG. 3 taken along line 3A-3A of FIG. 3 with the band in the stretched position Y.

Figure 2A:
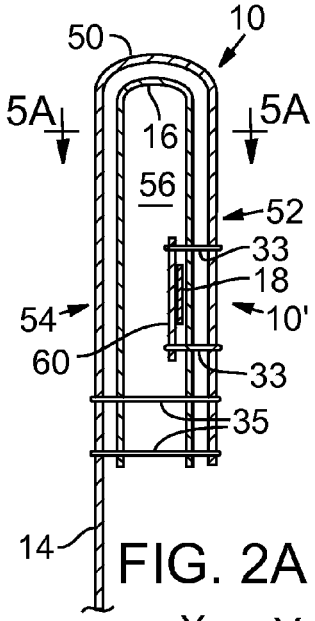
FIG. 2A is an exploded, cross-sectional view of a first embodiment of the resilient band taken along line 2-2 of FIG. 1.
Figure 3B:
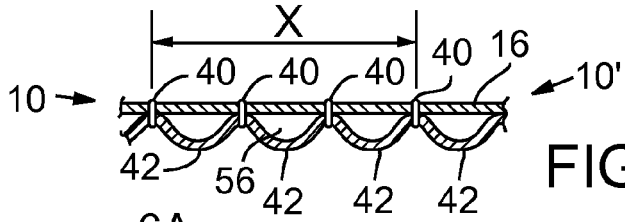

FIG. 3B is a partial, top view of the resilient band of FIG. 2A with the band in the neutral position X.

Figure 4:
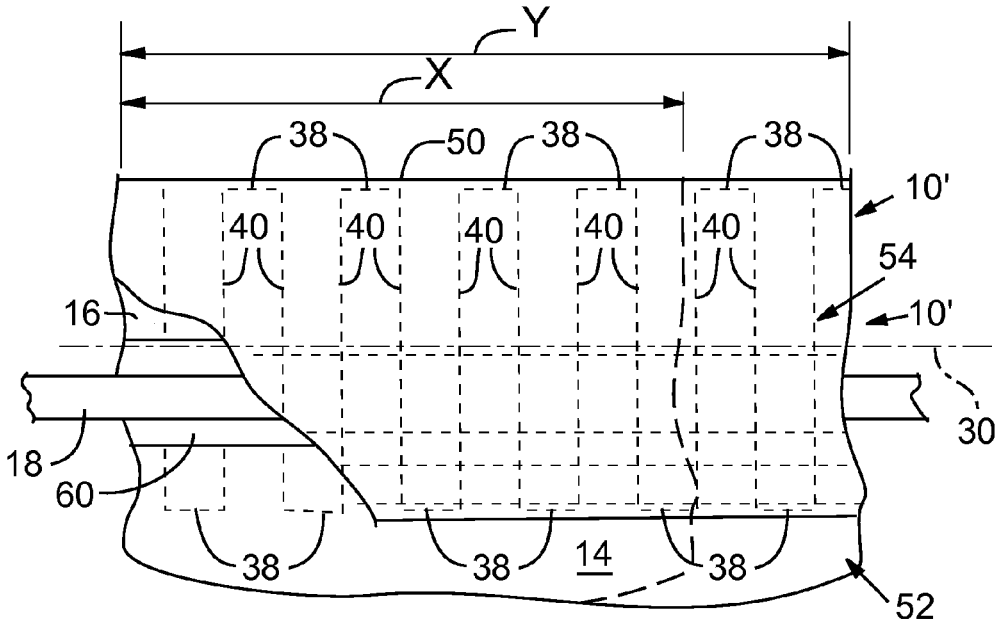

FIG. 4 is a partial, front view of the resilient band of FIG. 2A with a portion broken away to show internal detail.

Figure 2B:
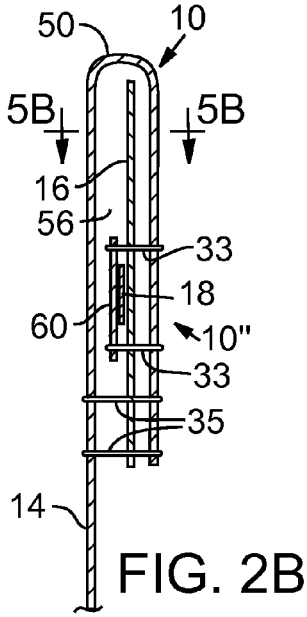
FIG. 2B is an exploded, cross-sectional view of a second embodiment of the resilient band taken along line 2-2 of FIG. 1.
Figure 5A:
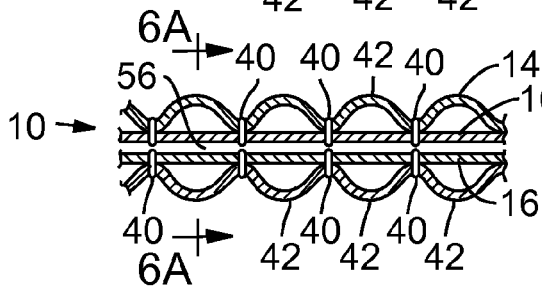
Figure 5B:
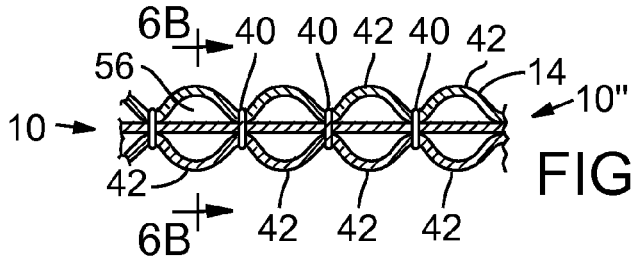

FIG. 5A is a partial, top view of the resilient band of FIG. 2A taken along line 5A-5A of FIG. 2A with the band in a neutral position FIG. 5B is a partial, top view of the resilient band of FIG. 2B taken along line 5B-5B of FIG. 2B with the band in a neutral position.

Figure 6A:
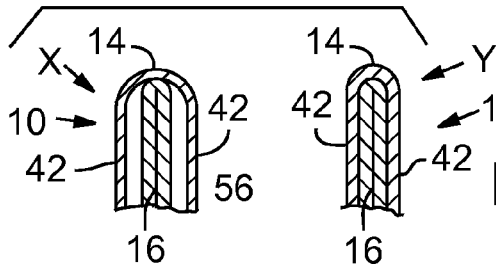

FIG. 6A is a partial cross sectional view of a portion of the band of FIG. 2A showing a possible neutral position X and stretched position Y.

Figure 6B:
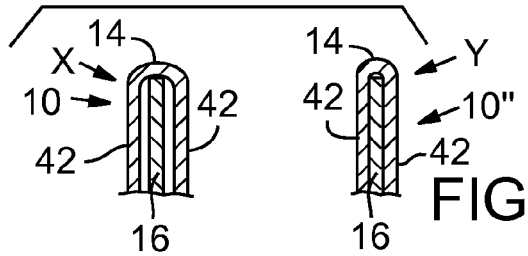

FIG. 6B is a partial cross-sectional view of a portion of the band of FIG. 2B showing a possible neutral position X and stretched position Y.

Corresponding reference numerals indicate corresponding parts throughout the several views of the drawings.

DETAILED DESCRIPTION

A resilient band 10 for an article of apparel 12, the band 10 formed with a sheet of first fabric 14 being operably secured to a more resilient sheet of second fabric 16, is shown in FIGS. 1-6B. A first preferred resilient band 10' embodiment is shown in FIGS. 2A, 3, 3A, 3B, 4, 5A and 6A, and a second preferred resilient band embodiment 10" embodiment is shown in FIGS. 2B, 5B, and 6B.

Figure 1:
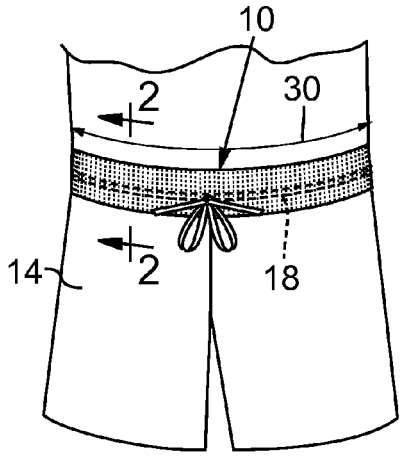

Referring to FIG. 1, the resilient band 10 is preferably a waistband 10A and the article of apparel 12 is preferably a pair of pants 12A, such as yoga pants. The resilient band 10 is operably secured to the article of apparel 12, and a draw string 18, may be operably received within the resilient band 10 as shown.

The first fabric 14 is preferably a soft, stretchy fabric, such as fleece or the like, that may also form an outer surface 20 of the article of apparel 12. For example, FIGS. 1, 2A and 2B show the first fabric 14 extending beyond the resilient band 10 to also form the pair of pants 12A.

The second fabric 16 is selected from a group of fabrics that are more resilient than the first fabric 14. It is preferable to encircle the first fabric 14 around the second fabric 16 as best shown in FIGS. 2A and 2B so that the second fabric 16 does not contact the wearer. One known second fabric 16 that has particularly desirable resiliency characteristics is known in the industry as "powermesh," which is a thin, sturdy, breathable, flexible fabric that is preferably stretchable in all directions, but also readily seeks to return to a neutral, unstretched position.

Preferably, the powermesh fabric used as the second fabric 16 is composed of 70 to 90 percent nylon or polyester with the corresponding remaining material comprising spandex. More preferably, the powermesh fabric is warp knit mesh construction formed of 75 to 85 percent nylon or polyester with the remaining material comprising spandex. Even more preferably, the powermesh fabric is formed of less than 20 percent spandex such as 81 percent nylon or polyester and 19 percent spandex.

Other materials having the general elasticity, resiliency, and light fabric weight of powermesh may also be used. These fabric properties are preferably within the following ranges: Fabric weight of 180 grams per meter squared plus or minus 10 percent, and using the stretch recover properties defined by an industry standard test known as ASTM D2594, the resiliency, or "growth properties," of the fabric in the length (wales) direction is preferably equal to a maximum 10 percent, with the width (courses) direction equal to a maximum of 5 percent. The corresponding desired elasticity using a 10 pound stretch property test is preferably between 80 to 100 percent in the length (wales) direction, and between 40 to 60 percent in the width (courses) direction.

The first and second fabrics 14, 16, respectively, are operably secured together so as to not unduly limit the stretchability of the resulting resilient band 10 in all directions. For example, and as shown in FIGS. 3, 3A, 3B and 4, the first and second fabric 14, 16 are placed on top of each other and then urged to a stretched position Y along the longitudinal length 30 of the resulting resilient band 10. The fabrics 14, 16 are secured together while both are in their stretched positions Y and the resulting fabric structure 32 is released to a neutral position X after the two fabrics 14, 16 are secured together.

Preferably, the first and second fabrics 14, 16 are secured together so as to prevent a substantial continuous seam parallel to the longitudinal length 30 of the resilient band 10. For example, the first and second fabrics 14, 16 may be stitched together with a plurality of spaced-apart, substantially parallely-aligned stitches 40 that may be aligned substantially vertically and perpendicular to the longitudinal centerline 30 of the resilient band 10 as shown in FIG. 3.

The resulting stitching pattern will allow the first and second fabrics 14, 16 to rest substantially parallel to each other in the stretched position Y shown in FIG. 3A, but the first fabric 14 will tend to form small, and aesthetically pleasing, curtain-type pleats 42 when the resulting fabric structure 32 is released to its neutral position X as shown in FIG. 3B.

More preferably, the stitching may follow a substantially continuous serpentine pattern 36 along the longitudinal length 30 of the resilient band 10 with cross-over stitching 38 alternating which end to cross-over to the next substantially vertical parallel line 40 of stitching so as to prevent a substantially continuous horizontal seam along the longitudinal length 30 of the resilient band. Even more preferably, the horizontal cross-over stitching 38 extends between two adjacent, substantially vertical and parallel stitching lines 40, with the horizontal cross-over stitching 38 being vertically spaced apart from adjacent cross-over stitching 40 so as to not impede the longitudinal stretching of the resulting resilient band 10, particularly in the direction of the stretched position Y shown in FIG. 4.

Referring to FIGS. 1, 2A, 3, 4, 5A, and 6A a first construction configuration of the resilient band 10' is disclosed. The first and second fabrics 14, 16 are operably secured together as previously described, and the resulting fabric structure 32 is folded over upon itself at fold-line 50 to define a first portion 52 and second portion 54 of the resulting fabric structure 32 and form an internal pocket 56 as best shown in FIG. 2A. The first and second portions 52, 54 are then operably secured together. In the exemplary embodiment of FIG. 2A, for instance, one or more first fastening structures 35 extend transversely through the thickness of resilient band 10' to attach first and second portions 52, 54 together. First fastening structure(s) 35 can, thus, extend transversely through first portion 52 and second portion 54 of first fabric 14 and through first portion 52 and second portion 54 of second fabric 16. It will also be appreciated that first fastening structure(s) 35 can be stitching as discussed above.

If desired, the draw string 18 may be operably received in the internal pocket 56 with the ends of the draw string 18 extending through openings 58 (FIG. 1) through an outer wall of the resilient band 10 so as to allow a user to tie the drawstring together. Preferably, a draw string retention panel 60 is operably secured to the fabric structure 32 within the internal pocket 56 so as to maintain proper positioning and alignment of the drawstring within the internal pocket 56 as shown in FIGS. 2A and 4. Specifically, as shown in the exemplary embodiment of FIG. 2A, one or more second fastening structures 33 can extend transversely through the thickness of band 10' to attach first portion 52 of first fabric 14, first portion 52 of second fabric 16, and draw string retention panel 60. It is also noted that second fastening structure(s) 33 can terminate inside pocket 56 in the transverse direction to stop short of extending through second portion 54 of first and second fabrics 14, 16. Moreover, it will be appreciated that second fastening structure(s) 33 can be stitching as discussed above.

Referring to exemplary embodiments of FIGS. 2B, 5B and 6B, an alternative resilient band 10" construction configuration is disclosed. The first fabric 14 is operably secured to a thin strip of second fabric 16 to form a resulting fabric structure 32 as previously described. Then, the resulting fabric structure 32 is folded over the first fabric 14 as best shown in FIG. 2B so as to allow the first fabric 14 to encircle the inner second fabric 16 and define an internal pocket 56. This construction configuration results in a single layer of inner second fabric 16, and therefore a thinner resilient band 10". Also, first fastening structures 35 can attach first fabric 14 and second fabric 16, and second fastening structures 33 can attach first fabric 14, second fabric 16, and draw string retention panel 60, similar to the embodiments discussed above.

If desired, the draw string 18 may be operably received within the internal pocket 56 of this configuration as previously shown and described.

The resulting resilient band 10 is bulk free and easily flexible in all directions, including along the longitudinal length 30 of the band, while still offering superior holding ability through the entire range of motion of the wearer.

The foregoing description of the embodiments has been provided for purposes of illustration and description. It is not intended to be exhaustive or to limit the invention. For example, although the disclosed first fabric 14 is described as also serving as the fabric for forming the article of apparel 16, the resilient band 10 of the present invention may be a discrete structure that is separate from the article of apparel 12 to which it is attached. Similarly, the article of apparel may not be a pair of paints, but a jacket or the like with the resilient band forming a wrist-strap, waist strap or the like thereon.

Also, the stitching methods and structures for securing the two fabrics 14, 16 together are for exemplary purposes only. Other securing methods, such as heating, using adhesives, and the like may also be used so long as the resulting securing structures do not unduly limit the range of movement of the resulting resilient band 10 as described. In addition, the disclosed parallely-aligned patterns for securing the two fabrics 14, 16 together need not form straight lines nor be aligned substantially perpendicular to the longitudinal length 30 of the resilient band 10.

Similarly, individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

We claim:

1. A resilient band for an article of apparel that defines a longitudinal length and a cross section taken in a transverse direction that is transverse to the longitudinal length, the resilient band comprising:

a first resilient fabric with a first resiliency, the first resilient fabric in the cross section being folded over upon itself at a fold to define a first portion, a second portion that overlaps the first portion, and a pocket between the first and second portions, the pocket being closed off at the fold and open at an end that is opposite the fold;

a second resilient fabric with a second resiliency, the second resilient fabric in the cross section being disposed within the pocket, the second resilient fabric being operably secured to the first resilient fabric, said second resiliency greater than said first resiliency;

a first fastening structure that extends in the transverse direction through the first resilient fabric and the second resilient fabric to attach the first resilient fabric and the second resilient fabric together, the first fastening structure extending in the transverse direction through each of the first portion of the first resilient fabric, the second resilient fabric, and the second portion of the first resilient fabric; and a second fastening structure that extends in the transverse direction through the first resilient fabric and the second resilient fabric to attach the first resilient fabric and the second resilient fabric together, the second fastening structure extending in the transverse direction through the first portion of the first resilient fabric and the second resilient fabric, and the second fastening structure terminating in the transverse direction inside the pocket to stop short of extending through the second portion of the first resilient fabric, wherein the resilient band defines a waistband for the article of apparel.

2. The resilient band for an article of apparel of claim 1, wherein said first resilient fabric defines the article of apparel.

3. The resilient band for an article of apparel of claim 1, wherein said first resilient fabric has a neutral position and a stretched position; and, said second resilient fabric has a neutral position and a stretched position, said first resilient fabric is operably secured to said second fabric when both first and second fabrics are in their stretched positions such that the first resilient fabric includes a plurality of pleats when the first and second resilient fabrics are in the respective neutral positions.

4. The resilient band for an article of apparel of claim 1, wherein said waistband further includes a drawstring.

5. The resilient band for an article of apparel of claim 1, wherein said article of apparel is a pair of pants.

6. The resilient band for an article of apparel of claim 1, wherein said second resilient fabric is a powermesh fabric.

7. The resilient band for an article of apparel of claim 1, wherein said second resilient fabric includes spandex.

8. The resilient band for an article of apparel of claim 7, wherein said second resilient fabric is between 70 to 90 percent nylon.

9. The resilient band for an article of apparel of claim 8, wherein said second resilient fabric is between 75 to 86 percent nylon.

10. The resilient band for an article of apparel of claim 7, wherein said second resilient fabric is less than 20% spandex.

11. The resilient band for an article of apparel of claim 1, wherein said second resilient fabric is selected from the group of fabrics having a weight of 180 grams/meter squared plus or minus 10 percent.

12. The resilient band for an article of apparel of claim 11, wherein said second resilient fabric has a growth property of no more than 10 percent in a length direction and no more than 5 percent in a width direction.

13. The resilient band for an article of apparel of claim 12, wherein said second resilient fabric has a 10 pound stretch property of between 80 to 100 percent in the length direction and between 50 to 60 percent in the width direction.

14. The resilient band for an article of apparel of claim 1, wherein said first resilient fabric is operably secured to said second resilient fabric with stitching, the stitching defining at least one of the first and second fastening structures.

15. The resilient band for an article of apparel of claim 14, wherein said resilient band has a longitudinal centerline, and said stitching is aligned substantially perpendicular to said longitudinal centerline.

16. The resilient band for an article of apparel of claim 14, wherein said resilient band has a first end and an opposite second end, and said stitching:

has a plurality of segments spaced apart from each other, the plurality of segments being substantially perpendicular to a longitudinal centerline;

is continuous from said first end to said opposite second end; and, follows a path from said first end to said opposite second end so as to prevent a continuous line of stitching that is aligned substantially parallel to said longitudinal centerline from extending longer than the distance between two adjacent segments.

17. The resilient band for an article of apparel of claim 1, wherein said first and second resilient fabrics are operably secured together with stitching extending in a substantially serpentine pattern along said longitudinal length, the stitching defining the first fastening structure.

18. The resilient band for an article of apparel of claim 1, wherein said first and second fastening structures are aligned substantially perpendicular to said longitudinal length of the resilient band.

19. The resilient band for an article of apparel of claim 1, wherein said first and second fastening structures are stitches.

20. The resilient band for an article of apparel of claim 1, wherein said first resilient fabric and said second resilient fabric are operably secured together so as to avoid a substantially elongated seam aligned with the longitudinal length of the resilient band.

21. The resilient band of claim 1, further comprising a drawstring that is disposed within the pocket.

22. The resilient band of claim 21, further comprising a retention panel that cooperates with the second resilient fabric to define a passage therebetween, the drawstring being disposed within the passage.

23. The resilient band of claim 22, wherein the second fastening structure also extends through the retention panel to attach the retention panel to the first portion of the resilient fabric and the second resilient fabric.

24. The resilient band of claim 1, wherein the second resilient fabric in the cross section is folded over on itself.

25. The resilient band of claim 1, wherein the resilient band terminates at the fold of the first resilient fabric.

26. The resilient band for an article of apparel of claim 1, wherein one of said first portion and said second portion of said first resilient fabric defines an inner surface of the waistband and the other of said first portion and said second portion of said first resilient fabric defines an outer surface of the waistband, wherein said first fastening structure is defined by stitching that extends continuously in a serpentine fashion generally along the longitudinal length of the waistband, alternating between extending across said inner surface of the waistband and said outer surface of the waistband.

27. A resilient band for use on an article of apparel that defines a longitudinal centerline and a cross section taken in a transverse direction that is transverse to the longitudinal centerline, said resilient band comprising:

an elongate first resilient fabric having a first end and an opposite second end, the first resilient fabric in the cross section being folded over upon itself at a fold to define a first portion, a second portion that overlaps the first portion, and a pocket between the first and second portions, the pocket being closed off at the fold and open at an end that is opposite the fold;

an elongate elastic element, the elongate elastic element in the cross section being disposed within the pocket and aligned along said longitudinal centerline, the elongate elastic element extending substantially from said first end to said opposite second end; and, a plurality of spaced-apart fasteners operably securing said first resilient fabric to said elastic element, said fasteners aligned substantially perpendicular to said longitudinal centerline, said fasteners including:

a first fastening structure that extends in the transverse direction through the first resilient fabric and the second resilient fabric to attach the first resilient fabric and the second resilient fabric together, the first fastening structure extending in the transverse direction through each of the first portion of the first resilient fabric, the second resilient fabric, and the second portion of the first resilient fabric; and a second fastening structure that extends in the transverse direction through the first resilient fabric and the second resilient fabric to attach the first resilient fabric and the second resilient fabric together, the second fastening structure extending in the transverse direction through the first portion of the first resilient fabric and the second resilient fabric, and the second fastening structure terminating in the transverse direction inside the pocket to stop short of extending through the second portion of the first resilient fabric, wherein the resilient band defines a waistband for the article of apparel.

28. The resilient band for use on an article of apparel of claim 27, wherein said plurality of spaced-apart fasteners are stitches.

29. The resilient band for use on an article of apparel of claim 28, wherein said stitches form lines, and said lines are parallelly-aligned.

30. The resilient band for use on an article of apparel of claim 27, wherein said elongate elastic element is a second resilient fabric that is more resilient than the first resilient fabric.

31. The resilient band for use on an article of apparel of claim 27, wherein said elongate elastic element is a strip of powermesh.

32. An article of apparel with a lower portion and a waistband portion that is disposed above the lower portion, the waistband portion defining a longitudinal length and a cross section taken in a transverse direction that is transverse to the longitudinal length, the article of apparel comprising:

a first resilient fabric with a first resiliency, the first resilient fabric defining the lower portion and a part of the waistband portion, the first resilient fabric in the cross section being folded over upon itself at a fold to define a first portion, a second portion that overlaps the first portion, and a pocket between the first and second portions;

a second resilient fabric with a second resiliency, the second resilient fabric in the cross section being disposed within the pocket, said second resiliency greater than said first resiliency;

a first stitch that extends in the transverse direction through the first resilient fabric and the second resilient fabric to attach the first resilient fabric and the second resilient fabric together, the first stitch extending in the transverse direction through each of the first portion of the first resilient fabric, the second resilient fabric, and the second portion of the first resilient fabric; and a second stitch that extends in the transverse direction through the first resilient fabric and the second resilient fabric to attach the first resilient fabric and the second resilient fabric together, the second stitch extending in the transverse direction through the first portion of the first resilient fabric and the second resilient fabric, and the second stitch terminating inside the pocket to stop short of extending through the second portion of the first resilient fabric.

* * * * *